United States Patent [19]

Hoeptner, III

[11] Patent Number: 5,033,500

[45] Date of Patent: Jul. 23, 1991

[54] FREEZE VALVE APPARATUS

[76] Inventor: Herbert W. Hoeptner, III, 15085 Venetian Way, Morgan Hill, Calif. 95037

[21] Appl. No.: 604,160

[22] Filed: Oct. 29, 1990

[51] Int. Cl.[5] ..... E03B 7/12; E03B 9/14

[52] U.S. Cl. ..... 137/282; 137/301; 138/32; 239/106; 239/124; 417/187

[58] Field of Search ..... 137/59, 69, 272, 281, 137/282, 291, 301, 302, 565, 570, 888, 891, 892, 893; 138/27, 32, 35; 239/106, 124; 251/122; 417/151, 187

[56] References Cited

U.S. PATENT DOCUMENTS

| | | | |
|---|---|---|---|
| 196,384 | 10/1877 | Porteous | 137/282 |
| 519,728 | 5/1894 | McGowan | 417/187 |
| 1,786,357 | 12/1930 | Miller | 137/892 |
| 1,987,883 | 1/1935 | White et al. | 137/892 |
| 2,580,199 | 12/1951 | Schmid | 137/301 |
| 2,598,488 | 5/1952 | Bart | 137/282 |
| 2,598,968 | 6/1952 | Boosey | 137/282 |
| 2,605,781 | 8/1952 | Schmid et al. | 137/282 |
| 2,664,096 | 12/1953 | Murdock et al. | 137/282 |
| 3,017,896 | 1/1962 | Papacek | 137/282 |
| 3,770,003 | 11/1973 | Uroshevich | 137/281 |
| 3,885,585 | 5/1975 | Carpentier | 137/282 |
| 4,109,671 | 8/1978 | Hughes et al. | 137/282 |
| 4,653,521 | 3/1987 | Fillman | 137/302 |
| 4,653,522 | 3/1987 | Fillman et al. | 137/281 |
| 4,854,339 | 8/1989 | Hoeptner, III | 137/282 |

*Primary Examiner*—George L. Walton
*Attorney, Agent, or Firm*—William W. Haefliger

[57] ABSTRACT

A freeze resisting valve apparatus, for controlling water flow, the combination comprising: a vertically elongated, hollow valve body having a lower portion adapted for installation underground, the body having a lower water inlet associated with the lower portion, and an upper water outlet, for passing a stream of pressurized water through the body; a water reservoir adapted for installation underground and having communication with the body lower portion via an ejector port; a valve seat projecting in the lower portion of the body and having a narrowed passage extending upwardly and positioned to increase pressurized water flow velocity in proximity to the port, the ejector port being proximate the level of the seat; a valve member tapering downwardly toward an apex always remaining in alignment with the narrowed passage as the stopper member moves toward and away from the seat to effect drainage of water in the valve body downwardly, in the body past the stopper to the reservoir when the stopper is closed on the seat with the apex at the narrow passage, and to effect inducing of water flow from the reservoir through the ejector port and into the stream and then upwardly in the body when the stopper is retracted upwardly from the seat; the reservoir being substantially coaxial with the stopper valve member and seat; and there being a shaft connected with the stopper and extending upwardly in the body, the body having a reduced diameter eductor bore in which the shaft extends with annular clearance to form an eductor passage through which water flows to and from the stopper.

13 Claims, 1 Drawing Sheet

FREEZE VALVE APPARATUS

BACKGROUND OF THE INVENTION

This invention relates generally to freeze resisting valves, and more particularly to valves installable in such relation to the ground as to resist freeze-up in cold weather.

Freezing of water control valves in winter, as for example in remote locations, such as farms, ranches, etc. has been a persistent problem. There is need for a simple, reliable valve that does not require heating, as by electricity or other means, and that will resist, and prevent, freeze-up in normal winter conditions; that is sanitary, will not contaminate the water supply, and that is a self-contained hydrant.

There is also need for a freeze valve wherein water is educted into a valve body that extends vertically, from a reservoir that extends about that body, and wherein water may readily flow vertically in an eductor passage, past a stopper control shaft.

SUMMARY OF THE INVENTION

It is a major object of the invention to provide a simple, reliable valve apparatus to meet the above need. Basically, the apparatus is adapted to control water flow, and includes:

a) a vertically elongated, hollow valve body having a lower portion adapted for installation underground, the body having a lower water inlet associated with said lower portion, and an upper water outlet, for passing a stream of pressurized water through said body, b) a water reservoir adapted for installation underground and having communication with said body lower portion via an ejector port, c) a valve seat projecting in said lower portion of the body and having a narrowed passage extending upwardly and positioned to increase pressurized water flow velocity in proximity to said port, said ejector port being proximate the level of said seat, d) and a valve member tapering downwardly toward an apex always remaining in alignment with said narrowed passage as the stopper member moves toward and away from the seat to effect drainage of water in the valve body downwardly, in said body past the stopper to the reservoir when the stopper is closed on the seat with said apex at said narrow passage, and to effect inducing of water flow from the reservoir through said ejector port and into said stream and then upwardly in said body when the stopper is retracted upwardly from the seat, e) said reservoir being substantially coaxial with the stopper valve member and seat, f) there being a shaft connected with the stopper and extending upwardly in the body, the body having a reduced diameter eductor bore in which said shaft extends with annular clearance to form an eductor passage through which water flows to and from the stopper.

The water in the reservoir does not freeze due to the fact that the reservoir is underground and in contact with the ground to receive ground stored heat. As will appear, the reservoir typically extends adjacent said body lower portion, the port located in the side of said body; and the reservoir may be annular to extend about the valve body lower portion, which is tubular and upright, the seat and stopper surrounded by the reservoir.

Another object is to provide the body with an enlarged bore in which said apex extends, said enlarged bore communicating with said eductor passage. As will be seen, the ejector port may intersect that enlarged bore, for water ejection or eduction toward the eductor passage.

A further object is to provide the eductor passage to be annular unobstructed, to allow maximum, unrestricted water flow, upwardly and downwardly in the eductor passage.

Yet another object is to provide a stopper that is downwardly tapered in the enlarged bore, so that water may flow vertically in said body, past the stopper, when the stopper is retracted away from the seat. Typically, the stopper has a lowermost closure located to engage the seat to close said passage; and the closure is advantageously tapered downwardly to define a lowermost tip centrally of said body, and said passage is also located centrally of said body to receive said tip.

A further object is to provide a breather duct communicating with said reservoir and extending upwardly toward an outlet, above ground level. A vent valve is typically provided in the breather duct to close when pressurized water in the body exerts pressure on the water in the reservoir. Also, a control valve is typically provided in series with the outlet, downstream of the stopper.

The present invention is an improvement over that disclosed in my prior U.S. Pat. No. 4,854,339 issued August 8, 1989.

These and other objects and advantages of the invention, as well as the details of an illustrative embodiment, will be more fully understood from the following specification and drawings, in which:

DRAWING DESCRIPTION

DETAILED DESCRIPTION

Figure 1:
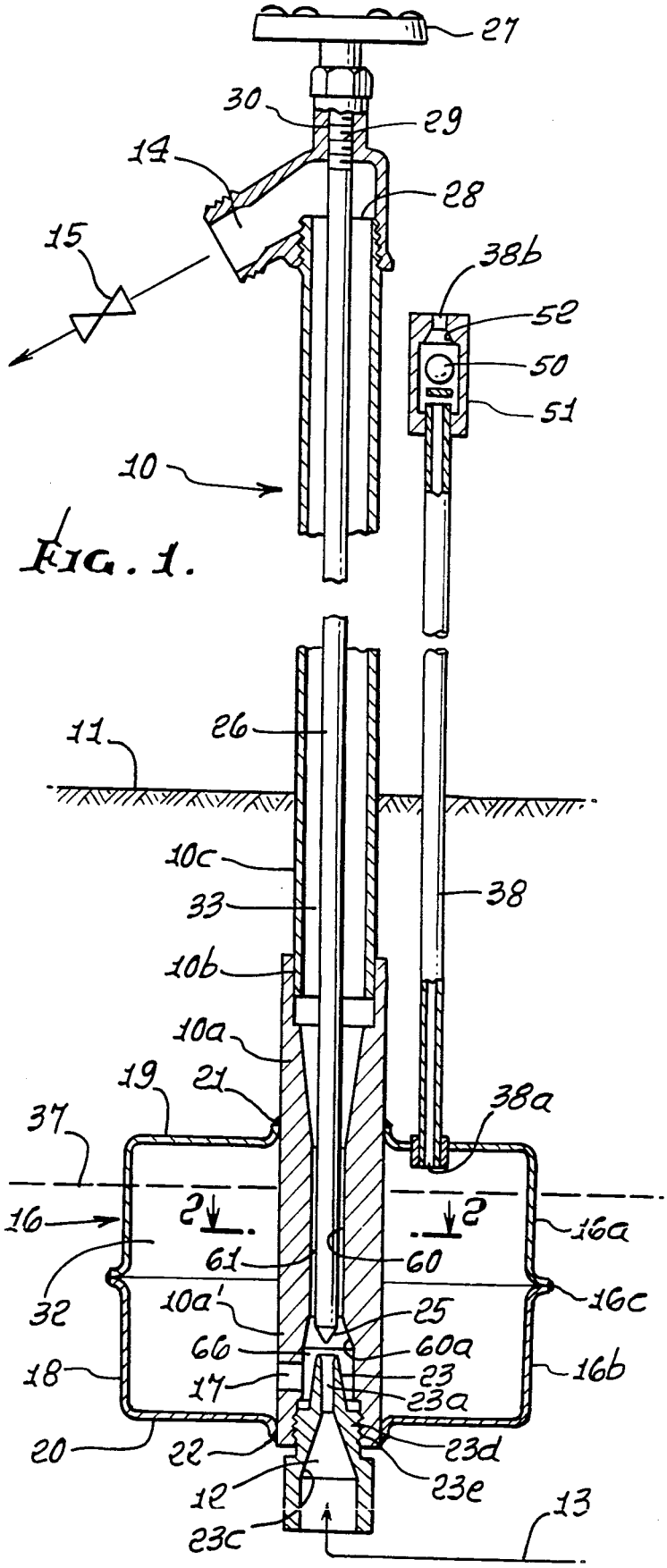
FIG. 1 is an elevation in section, showing the freeze resisting valve in open condition, the reservoir extending underground.
Figure 2:
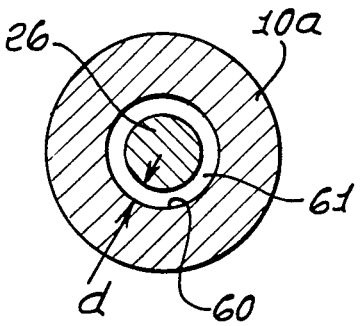
FIG. 2 is a section on lines 2—2 of FIG. 1.

In the drawings, the vertically elongated, hollow valve body 10 may be tubular, as shown. It has a lower portion 10*a* adapted for installation underground, and in this regard, ground surface level may for example be located at 11. The body lower portion 10*a* has a lower water inlet 12 to receive water from an underground pipe 13. The body 10 also has upper water outlet, as at 14, for passing a stream of pressurized water upwardly through the body 10 when the valve apparatus is open, and when a downstream control valve 15 is also open, the latter valve being employed if needed.

A water reservoir 16 is provided and is adapted for installation underground, and to have communication with the body lower portion 10*a*, as via an ejector port. The latter is typically located in the side wall 10*a'* of the body lower portion 10*a*, and is indicated at 17. The reservoir may be annular as shown, with a cylindrical outer wall 18, and top and bottom annular walls 19 and 20 attached to the body at 21 and 22.

The reservoir 16 may be made in two sections 16*a* and 16*b*, interconnected as by welding at 16*c*. Also the body 10 lower portion 10*a* may be a tubular part which is telescopically connected at 10*b* with body upper section 10*c*.

A valve seat 23 is formed by a tubular plug 23*d* threaded into the body lower portion 10*a*', at 23*e*. Seat 23 may consist of brass, and body lower portion 10*a* and upper portion 10*b* may consist of steel, i.e. of much less cost than brass. The seat has a narrower passage 23*a* positioned to increase pressurized water flow velocity in proximity to the port 17. Thus the seat may act as a venturi. Note in the example the upwardly tapered upper and lower walls 23*b* and 23*c* of the seat, passage 23*a* being centered relative to the body lower portion 10*a*. Upward velocity of water exiting from passage 23*a* is enhanced, so that associated water pressure is reduced, whereby water that has drained into the reservoir from the valve body upper portion (above ground) when the valve was closed, is induced or educted via port 17 into the water stream passing to outlet 14, to empty, or substantially empty the reservoir, above the level of port 17, when the valve is opened.

Figure 3:
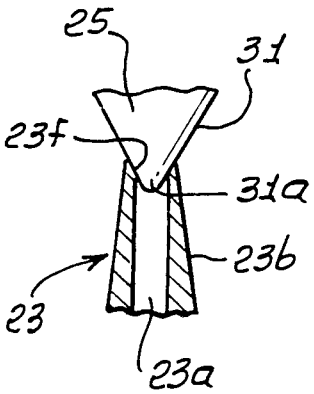
FIG. 3 is a section showing the valve stopper in closed position.

A stopper or stopper valve member 25 is provided in the body 10 to be movable up and down, as by stem 26 and handle 27. Stem extends axially within the body 10, and handle 27 is located above the upper end 28 of the body. Threads may be provided at 29 and 30 to allow turning of the handle to raise and lower the stopper. The stopper has a downwardly tapered surface at 31 so that a lowermost apex such as a tapered lower tip or centered closure 31*a* may enter the upper end of the passage 23*a* to seat therein at 23*f* and close the valve when the stopper is lowered. See FIG. 3. In that position water drains into the reservoir interior 32 from the valve body interior 33, via the port 17. A typical valve surface level of water in the reservoir and in the valve body lower portion 10*a* is indicated at 37, when the valve is closed. Level 37 is below ground surface level, so that all water that remains in the valve apparatus after stopper closing is below ground level to receive ground heat, preventing freezing.

It will be noted that body portion 10*a* has a reduced diameter, vertically elongated eductor bore 60 in which or through which the shaft stem 26 extends, with full annular clearance to form an annular eductor passage 61 through which water may flow up and down. Passage 61 is of such radial dimension "d" that water flows at increased velocity upwardly (when the freeze valve is open) thereby creating suction at port 17 acting to draw water from reservoir 16 into the upwardly flowing water stream in the passage 66. By reducing the diameter of bore 60, and of the stem 26, the annular area at the clearance at 61 may be made small enough to efficiently educt water from the reservoir, for upward flow; at the same time, the annular area at 61, and the dimension "d" may be kept large enough so as to minimize any frictional surface drag on the upwardly flowing water, that would otherwise tend to slow upward water velocity and thereby reduce the eduction efficiency.

Bore 60 opens downwardly via flare 60*a* into an enlarged chamber 66 intersected by side port 17. Flare or taper 60*a* leads water flow at accelerated velocity into passage 61, aiding eduction of water flow from the interior of 16 and via 17 into 66 and 61. Passage 61 is annularly uninterrupted, to enhance this effect, and shaft stem 26 remains centered in bore 60.

A breather duct 38 communicates at its lower ported end 38*a* with the reservoir interior; and the duct extends upwardly and above ground level, i.e., to an outlet 38*b*. A float ball 50 is located in a valving cage 51 at the upper end of 38. The ball in "up" position seats at conical seat 52, closing off outlet 38*b*. The ball 50 thus permits the cannister 16 to "breath" when it fills and empties with water.

When valve 15 is closed, water will fill cannister 16 and the vent tube 38. When water reaches vent ball 50, it will float to seat at 52. This will prevent water from exiting the vent tube. Once valve 15 is open and water velocity via 10 is increased, water is evacuated from cannister 16, and ball 50 will move away from seat 52 and will allow air to equalize waterloss in the cannister.

In operation, the vent at 38*a* is normally open, permitting the reservoir interior to breath, i.e., communicate with the exterior, via duct 38, as during filling and draining.

I claim:

1. In freeze resisting valve apparatus, for controlling water flow, the combination comprising:

a) a vertically elongated, hollow valve body having a lower portion adapted for installation underground, the body having a lower water inlet associated with said lower portion, and an upper water outlet, for passing a stream of pressurized water through said body, b) a water reservoir adapted for installation underground and having communication with said body lower portion via an ejector port, c) a valve seat projecting in said lower portion of the body and having a narrowed passage extending upwardly and positioned to increase pressurized water flow velocity in proximity to said port, said ejector port being proximate the level of said seat, d) and a valve member tapering downwardly toward an apex always remaining in alignment with said narrowed passage as the stopper member moves toward and away from the seat to effect drainage of water in the valve body downwardly, in said body past the stopper to the reservoir when the stopper is closed on the seat with said apex at said narrow passage, and to effect inducing of water flow from the reservoir through said ejector port and into said stream and then upwardly in said body when the stopper is retracted upwardly from the seat, e) said reservoir being substantially coaxial with the stopper valve member and seat, f) there being a shaft connected with the stopper and extending upwardly in the body, the body having above said apex a reduced diameter eductor bore in which said shaft extends with annular clearance to form an eductor passage through which water flows to and from the stopper, said body having an enlarged bore with an upwardly tapering portion in which said apex extends, when spaced from the seat, said enlarged bore directly communicating with said eductor passage, said tapering bore portion located immediately above the level of said ejector port, said ejector port intersecting said enlarged bore, said seat located between said ejector port and said upwardly tapering bore portion.

2. The combination of claim 1 wherein said passage is annularly uninterrupted, the shaft being centered in said eductor bore.

3. The apparatus of claim 1 wherein said reservoir extends adjacent said body lower portion, the port located in the side of said body.

4. The apparatus of claim 3 wherein the reservoir extends abut the body lower portion, which is tubular.

5. The apparatus of claim 6 wherein the seat and stopper valve member are surrounded by the reservoir.

6. The apparatus of claim 1 wherein said apex defines a lowermost tip centrally of said body, and said passage is also located centrally of said body to receive said tip.

7. The apparatus of claim 1 including a breather duct communicating with said reservoir and extending upwardly toward an outlet, above ground level.

8. The apparatus of claim 7 including vent means associated with said breather duct to pass air from the reservoir to the duct as water enters the reservoir, and to pass air into the reservoir via the duct when water flows from the reservoir into said body, said vent means including a float ball valve proximate the upper end of the breather duct, and a seat to seat the ball.

9. The apparatus of claim 1 including a control valve connected in series with said outlet downstream of the stopper.

10. The apparatus of claim 1 including a handle outside the body, which is manipulable to raise and lower the stopper valve member.

11. The apparatus of claim 1 wherein said seat has a lower side tapering upwardly toward said passage.

12. The apparatus of claim 1 wherein the ejector port is proximate the bottom of the reservoir.

13. The apparatus of claim 1 wherein the seat consists of brass, and the body consists of steel.

* * * * *